US009004760B2

(12) United States Patent
Tzortzis

(10) Patent No.: US 9,004,760 B2
(45) Date of Patent: Apr. 14, 2015

(54) BAG WITH DETACHABLE HANGING ACCESSORY PORTION

(71) Applicant: Sahra Tzortzis, New York, NY (US)

(72) Inventor: Sahra Tzortzis, New York, NY (US)

( * ) Notice: Subject to any disclaimer, the term of this patent is extended or adjusted under 35 U.S.C. 154(b) by 6 days.

(21) Appl. No.: 13/916,872

(22) Filed: Jun. 13, 2013

(65) Prior Publication Data

US 2014/0369628 A1 Dec. 18, 2014

(51) Int. Cl.
*B65D 30/22* (2006.01)
*B65D 33/06* (2006.01)

(52) U.S. Cl.
CPC ..... *B65D 33/06* (2013.01)

(58) Field of Classification Search
CPC .. A45C 3/004; A45C 13/02; A45C 2003/007; A45C 3/00; Y10S 190/903
USPC ..... 383/22, 23, 38, 40, 37, 39, 66; 190/107, 190/110, 113, 115
See application file for complete search history.

(56) References Cited

U.S. PATENT DOCUMENTS 3,122,225 A * 2/1964 Ward ..... 190/108
3,291,266 A * 12/1966 Komroff ..... 190/1
3,315,772 A * 4/1967 Katz ..... 206/287.1
3,512,621 A * 5/1970 Teetor ..... 206/287
3,777,862 A * 12/1973 Zipper ..... 190/107
3,944,032 A * 3/1976 Samhammer et al. ..... 206/292
4,391,396 A * 7/1983 Brady ..... 224/609
4,998,603 A 3/1991 Nordstrom
5,197,525 A * 3/1993 Cantor ..... 150/102
5,207,303 A * 5/1993 Oswalt et al. ..... 190/108
5,413,199 A * 5/1995 Clement ..... 190/108
5,515,954 A * 5/1996 Nordstrom ..... 190/18 A
5,566,797 A * 10/1996 Van Himbeeck ..... 190/18 A
6,000,509 A * 12/1999 Chisholm ..... 190/109
6,039,474 A * 3/2000 DeChant ..... 383/66
6,076,666 A 6/2000 Santa-Maria
6,129,210 A 10/2000 Rustemeyer et al.
6,193,034 B1 2/2001 Fournier
6,196,718 B1 * 3/2001 DeChant ..... 383/66
6,334,519 B1 * 1/2002 Tong ..... 190/107
6,883,654 B2 * 4/2005 Godshaw et al. ..... 190/115
6,948,599 B2 9/2005 Rodrigue et al.
7,051,908 B2 5/2006 Mignano et al.
7,171,707 B2 2/2007 Landay
7,207,426 B2 * 4/2007 Godshaw et al. ..... 190/1
D552,349 S * 10/2007 Greiner ..... D3/279
D566,964 S * 4/2008 Greiner ..... D3/293
D573,793 S * 7/2008 Bakker ..... D3/301
7,559,423 B2 * 7/2009 Vosloo ..... 206/315.1
7,604,102 B2 * 10/2009 Albritton ..... 190/107
7,861,857 B2 * 1/2011 Vorderkunz ..... 206/289

(Continued)

*Primary Examiner* — Jes F Pascua
*Assistant Examiner* — Peter Helvey
(74) *Attorney, Agent, or Firm* — Michael J. Feigin, Esq.; Feigin & Associates, LLC

(57) ABSTRACT

In an embodiment of the disclosed technology, a bag is used for transporting and organizing items. The bag is generally formed of a removably attachable upper and a lower portion. The upper portion forms at least a portion of one side of the bag and is attached to the lower portion by a fastening mechanism. The lower portion forms the bottom and at least a portion of the sides of the bag. The upper portion is detachable to provide a hanging accessory organizer, having pockets and suspension device. In embodiments of the disclosed technology, access to the bag may be provided by an additional fastenable opening. Zippers may be used as the fasteners, and may run parallel to one another, completely or partially surrounding the perimeter of the upper portion.

11 Claims, 7 Drawing Sheets

(56) References Cited

U.S. PATENT DOCUMENTS

| | | | | |
|---|---|---|---|---|
| 8,074,853 | B1 * | 12/2011 | Hirshberg | 224/655 |
| 8,181,775 | B2 | 5/2012 | Bunn | |
| 8,235,206 | B2 * | 8/2012 | Siegel et al. | 206/279 |
| 8,348,054 | B2 | 1/2013 | Dragan | |
| 2002/0074199 | A1 * | 6/2002 | Albritton | 190/107 |
| 2004/0007433 | A1 * | 1/2004 | Godshaw et al. | 190/18 A |
| 2007/0045370 | A1 * | 3/2007 | Hsieh | 224/576 |
| 2009/0052808 | A1 | 2/2009 | Pham et al. | |
| 2012/0048816 | A1 | 3/2012 | Brown | |

* cited by examiner

BAG WITH DETACHABLE HANGING ACCESSORY PORTION

FIELD OF THE DISCLOSED TECHNOLOGY

The disclosed technology relates generally to luggage and, more specifically, to bag with a removable portion.

BACKGROUND OF THE DISCLOSED TECHNOLOGY

Various types of luggage and baggage for traveling are known in the art. Many bags and suitcases seek to simplify the transporting and/or accessing of contents stored therein. Others are aimed at organizing all of the personal belongings carried by travelers. Bags have been introduced with a multitude of pockets and compartments to help travelers keep their belongings separate and secure, while maintaining accessibility. A popular piece of luggage amongst travelers is a toiletry/accessory bag that is compact, foldable, and suitable to be hung up in a bathroom or bedroom of their destination.

Still further, numerous travel restrictions have been introduced which affect a traveler's ability to travel with a lot of personal belongings. One such measure has been the crackdown by airlines on the size of carry-on and checked baggage. Many airlines charge travelers fees for over-sized bags, or even carry-on bags, in excess of one. These ever-increasing travel restrictions have forced travelers to seek innovative and resourceful ways of carrying the same quantity of items, while taking up significantly less space. For instance, it may be difficult for a traveler to fit an accessory/toiletry bag within a checked or carry-on baggage. If carrying these bags separately, a traveler may be charged excess bag fees by an airline or other transportation provider. Moreover, a traveler packing everything in a single bag or suitcase may find it difficult to quickly and conveniently access toiletries and/or accessories while in transit or upon reaching his/her destination.

SUMMARY OF THE DISCLOSED TECHNOLOGY

Therefore, it is an object of the disclosed technology to provide a single bag with a built-in removable and hangable accessory portion that forms a section of the bag with pockets which are accessible when opening the bag, as well as when removing a portion thereof to separately hang.

It is a further object of the disclosed technology to provide an improved bag partially formed by a detachable and suspendable portion with accessible pockets for conveniently storing items.

As such, in an embodiment of the disclosed technology, a bag is used for storing and/or transporting items. Such a bag combines a travel accessory bag and a regular bag. The bag has a unitary bottom, left, right, and back side, and a removably attached flexible top and front side. The unitary bottom, left, right, and back side, and the top and front side collectively form a contiguous unitary bag. For purposes of this disclosure, "bottom side" refers to the base of the bag, the bottom being the portion of the bag abutting a surface when the bag is positioned upright on that surface. The "top side" refers to the side directly opposite to the bottom, the top being generally where handles and/or straps would be located. "Front and back sides" refers to the elongated sides of the bag, the "front side" being the location of an opening mechanism on bags which do not open entirely from the top, and the "back side" being the non-descript rear side of the bag having few or no features. The "left and right sides" refers to the opposing sides forming the ends of a generally elongated bag, "the left and right sides" having a smaller surface area than that of the top, bottom, front and back sides. "Contiguous" refers to a surface which continues without an interruption larger than 1 cm. "Refers to" should be understood as a definition.

The removably attached flexible top and front side has at least one pocket. The top and front side may further have a hanging device, with a hook, attached thereto. When removed from the unitary bottom, left, right, and back side, the removably attached flexible top and front side is capable of being laid flat. That is, the flexible nature of the material enables the top and front side to be manipulated. In a hanging configuration, the top and front side will be generally planar, where "generally," for purposes of this disclosure, is defined as "what an ordinary observer would consider as such" or "at least 90% being as such." Thus, when the top and front side is called "generally planar," even though it may have pockets, fasteners, and other three-dimensional parts, it is still considered to be "generally planar."

In further embodiments, the removably attached flexible top and front side further forms at least a portion of the back side. Still further, the unitary bottom, left, right, and back side also forms at least a portion of the top side and/or the front side. In an embodiment, the bag also has a resealable opening that runs parallel to a portion of a perimeter of the removably attached flexible top and front side. That is, the resealable opening has a fastener similar to that used to attach the top and front side to the unitary bottom, left, right, and back side. A "perimeter" is defined as at least 95% of the length around one continuous edge of an object. The resealable opening is arranged such that the bag may be opened and closed without fully or partially detaching the flexible top and side. In embodiments, a zipper is used to fasten the flexible top and side to the unitary bottom, left, right, and back side. Furthermore, a zipper may be used for the resealable opening.

A method of using the bag described above is carried out, not necessarily in the following order, by: A) detaching the removably attached flexible top and front side from the unitary bottom, left, right, and back side, B) suspending the removably attached flexible top and front side from a fixed member such that access is provided to the pocket, and C) attaching the removably attached flexible top and front side to the unitary bottom, left, right, and back side to form the contiguous unitary bag.

In another embodiment of the disclosed technology, a bag has a bottom, sides, and top. A lower portion forms the bottom and at least a portion of the sides of the bag. A detachable upper portion having a pocket forms at least a portion of at least one side and/or the top of the bag. It should be understood that the use of "and/or" is defined inclusively, such that the term "a and/or b" should be read to include the sets: "a and b," "a or b," "a," "b." Thus, for example, the upper portion may form a portion of both the right side and the top of the bag, or, alternatively, the upper portion may just form a portion of the top of the bag.

A first fastener removably attaches the upper portion to the lower portion, such that, when attached, the upper portion and the lower portion form a contiguous unitary bag. A distinct, second fastener closably fastens the bag, thereby providing access to the contents of the bag. "Closably fastensing" or "closably fastening" is defined as releasably binding the edges of an opening of fabric or other flexible material. Further, "releasably" is defined as capable of being attached and detached, or coupled and uncoupled, repetitively without damaging or otherwise affecting the releasable parts. In embodiments, the second fastener outlines a flap formed by at least part of the upper portion.

In further embodiments, the upper portion has a hook rotatably affixed thereto. A "hook" is defined as a device having a bend or U-shape configured in a way that the bend or U-shape may be removably mounted onto a fixed object or member, such that the force of gravity keeps the hook mounted thereupon. In still further embodiments, the upper portion may be laid flat when detached from the lower portion. That is, the upper portion may be rested on a flat surface in a flattened condition. "Flat" is defined as having an elongated side, which, in a configuration, is at least 95% planar. An "elongated side" is elongated and forms a surface versus a narrow side which is an edge or joining side of two elongated sides.

In yet another embodiment of the disclosed technology, a method uses a bag having a plurality of sides, the sides being a top, bottom, front and back. The method is carried out, not necessarily in the following order, by: A) unfastening a fastener retaining an upper portion of the bag to a lower portion of the bag, the upper portion forming at least a portion of at least one side of said plurality of sides, B) removing the upper portion from the lower portion, and C) suspending the upper portion such that at least one pocket of the upper portion is accessible. A "fastener" is defined, for purposes of this specification, as a device used for releasably binding the edges of two sections of fabric or other flexible material. An additional step may be provided of fastening the fastener such that the upper portion and the lower portion form a contiguous unitary bag.

In further embodiments of the disclosed method, the fastener is a zipper, and the step of unfastening involves unzipping the upper portion. Still further, the upper portion further forms at least a portion of another side of the plurality of sides of the bag.

DETAILED DESCRIPTION OF EMBODIMENTS OF THE DISCLOSED TECHNOLOGY

In an embodiment of the disclosed technology, a hand-carry bag (also referred to, herein, as a "bag") has at least one fastener for opening and removing a suspendable upper portion. The fastener may be a zipper running between a lower portion and an upper portion, such that the zipper surrounds the upper portion. The lower portion forms a bottom and at least part of the sides, or a majority of the sides, of the bag forming a closed bag when the portions are fully attached thereto by the fastener. The upper portion forms a top and at least a part of the sides, or a minority of the sides, of the bag. The fastener extends around the periphery of the upper portion (also referred to, herein, as a "removably attached flexible top and front side"), making the upper portion disconnectable from the lower portion.

Upon disconnecting the upper and lower portions from one another, the lower portion continues to function as a bag, able to hold contents therein. The upper portion flattens, with a plurality of compartments thereto attached, and has a hanging mechanism for hanging the upper portion.

Embodiments of the disclosed technology will become clearer in view of the following description of the drawings.

Figure 1:
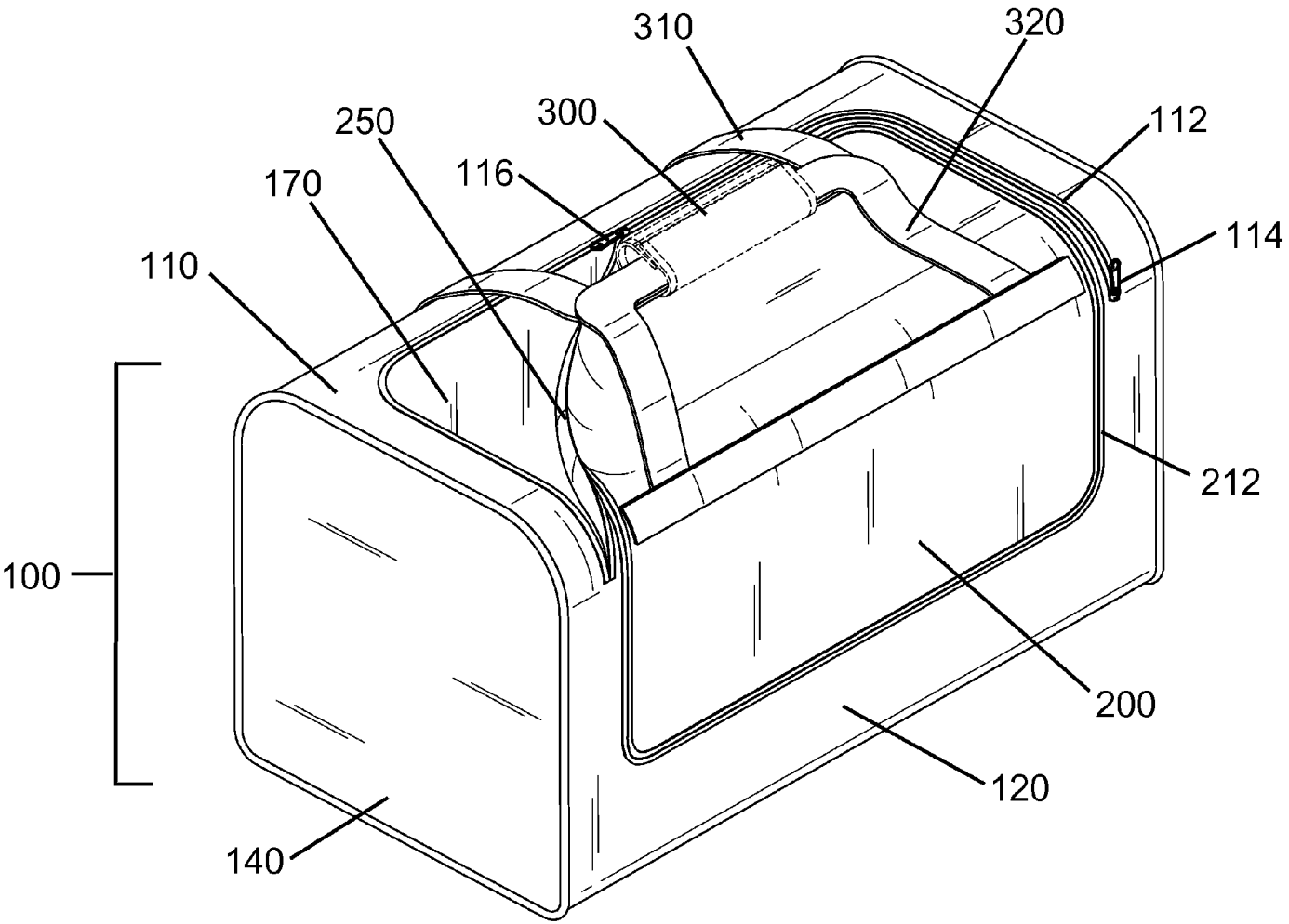
FIGS. 1 and 2 show a perspective view of a bag with an upper portion of an embodiment of the disclosed technology.
Figure 2:
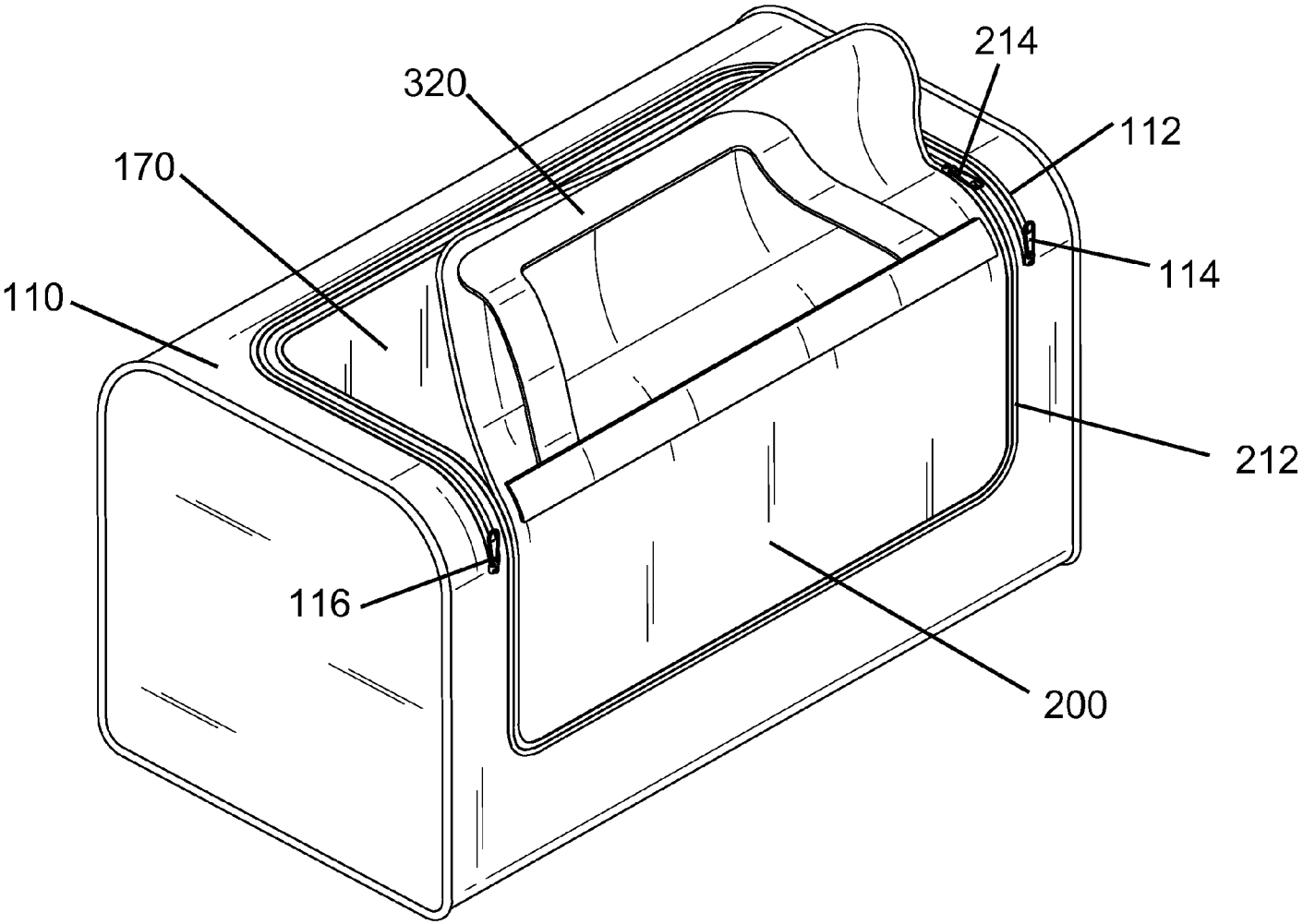

FIGS. 1 and 2 show a perspective view of a bag with a removable upper portion of an embodiment of the disclosed technology. The bag 100 of FIGS. 1 and 2 is generally rectangular, having a top side 110, bottom side 160 (not shown), front side 120, back side 130, and left and right sides 140, 150. While the bag 100 of FIGS. 1 and 2 is rectangular, the bag may be any shape, size, and/or dimensions. The bag 100 may be formed on any type of material, either semi-rigid or flexible, and the bag may have rigid sections.

The bag 100 has an inner fastener 212 surrounding an upper portion 200 thereof. In FIGS. 1 and 2, the inner fastener 212 is represented as a zipper (herein referred to as "inner zipper 212"); however, any type of fastener may be used, such as, for example, buttons, hook & loop fasteners, and/or buckles. The inner zipper 212 runs along the entire perimeter of the upper portion 200, such that the inner zipper 212 may be completely unzipped, thereby detaching the upper portion 200 from the rest of the bag 100 (i.e., the lower portion 105). The inner zipper 212 is opened and closed by an inner pull tab 214. The portion of the bag 100 that remains after the upper portion 200 has been removed may be referred to as the lower portion 105, or the remainder of the bag, because it may form a majority of the bag. That is, the lower portion 105 may account for approximately 75% or more of the exterior of the bag 100. Thus, for purposes of the specification, the upper portion 200 may be referred to as being detached from the bag 100 or the lower portion 105. When detached, the lower portion 105 remains, having an opening into the interior 170 of the bag 100. In this manner, the lower portion 105 may still serve a function of holding goods and/or clothing of the bag 100.

The bag 100 also has an outer fastener 112 for opening and closing the bag without detaching the upper portion 200. In FIGS. 1 and 2, the outer fastener 112 is represented as a zipper (herein referred to as "outer zipper 112"); however, any type of fastener may be used as described above with regard to the inner fastener 212. The outer zipper 112 runs partially, but not entirely, around the perimeter of the inner zipper 212. In embodiments, the outer zipper 112 may run along approximately 50% of the perimeter of the inner zipper 212. The outer zipper 112 has two outer pull tabs 114, 116. When the outer zipper 112 is opened and closed, the bag 100 is accessed through the opening 170 like any other bag known in the art. That is, a section of the upper portion 200 acts as a closable flap 250. If the outer zipper 112 is in an entirely unzipped state, the generally rectangular flap 250 is still attached to the bag by one of its four edges.

Referring specifically to FIG. 1, the bag 100 is being used with the flap partially open. The outer zipper 112 is partially unzipped to grant access to the interior 117 of the bag 100, while retaining the upper portion 200. The second pull tab 116 is positioned approximately halfway along the perimeter of the outer zipper 212. The inner zipper 212 remains closed, and thus the upper portion 200 is retained by the bag 100. Referring still to FIG. 1, a handle 300 is shown disposed around straps 310, 320. The handle 300 may be formed of fabric having a fastener, where "fastener" is defined for purposes of this specification as a device used for releasably binding the edges of two sections of, or an opening in, fabric or other flexible material. The fastener may be buttons, Velcro, or any other type of fastener. The handle 300 releasably encloses portions of the straps 310, 320. The first strap 310 is affixed to the top side 110 and/or the back side 130 of the bag 100. The second strap 320 is affixed to the upper portion 200. Thus, when the upper portion 200 is in a zipped configuration, the handle 300 may enclose both straps 310, 320, so that the bag can be carried and transported.

Referring now to FIG. 2, the bag 100 is shown with the upper portion 200 partially unzipped. The inner pull tab 214 is positioned such that approximately half of the inner zipper 212 is unzipped. Upon entirely unzipping the inner zipper 212, the upper portion 200 becomes detached from the lower portion 105. In this view, the outer zipper 112 is entirely zipped and closed. Moreover, the handle 300 is opened and removed. As such, the upper portion 200 may be lifted from the bag 100 by the second strap 320.

FIGS. 1 and 2 represent but one embodiment of the disclosed technology. The bag 100 must not necessarily be rectangular. The bag 100 may have any form, shape, size, and/or dimensions. Likewise, the upper portion 200 may form only a portion of one side of the bag 100, or the upper portion may form three, four, five, etc. sides of the bag 100. The upper portion 200 may also be any size, shape, and/or dimensions. For example, if the bag has a cylindrical shape, the upper portion 200 may form a curved rectangular portion of a wall of the cylindrical bag. The bag 100 may be formed of fabric, textile, leather or any other material that is used to construct luggage, purses, duffel bags and the like.

Figure 3:
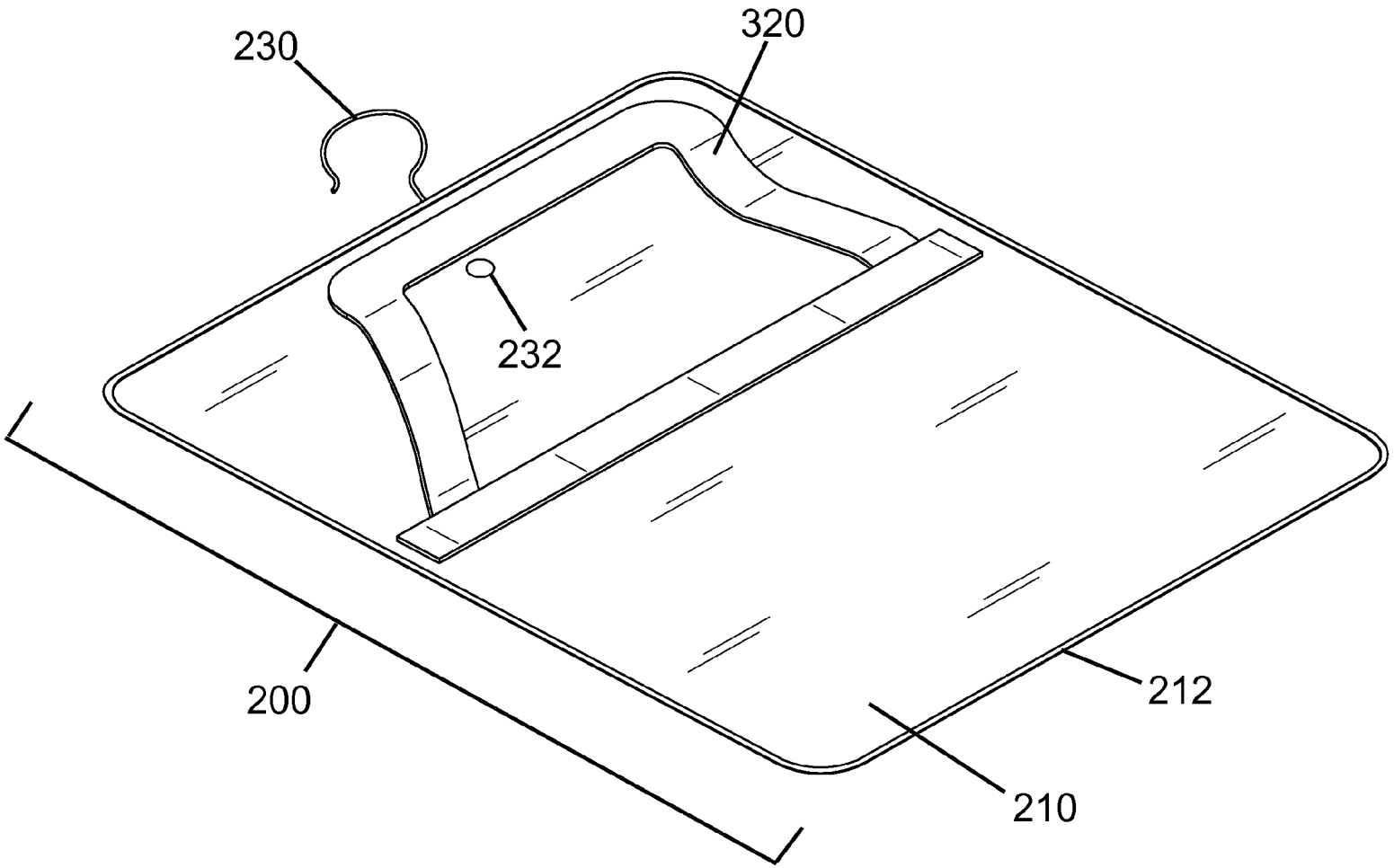
FIG. 3 shows a top perspective view of an upper portion of an embodiment of the disclosed technology.

FIG. 3 shows a top perspective view of an upper portion of an embodiment of the disclosed technology. In the view shown, the upper portion 200 is completely detached from the bag 100. The outer perimeter of the upper portion 200 is lined with the teeth of the inner zipper 212. The upper portion 200 is laid flat. The flexible nature of the material used to construct the upper portion 200 gives the upper portion the versatility to be folded, flattened or otherwise manipulated to suit the needs of a user. An outer surface 210 of the upper portion 200 has the second strap 320 attached thereto. As briefly discussed above, the strap 320 may still be used for carrying and transporting the upper portion 200.

A hanging device, in this case a hook 230, extends from an underside of the upper portion 200. The hook 230 is used for hanging, tethering and/or carrying the upper portion 200. The hook 230 is rotatably fastened to a point 232 on the upper portion 200. Thus, the hook 230 may rotate freely about the point 232. When the upper portion 200 is reattached to the bag 100, the hook 230 may be rotated inward so as not to obstruct the zippering of the inner zipper 212. The hanging device may be any other fastening mechanism known for suspending items, such as, for example, hook & loop straps, buckled straps, or any other releasable attachment mechanism.

Figure 4:
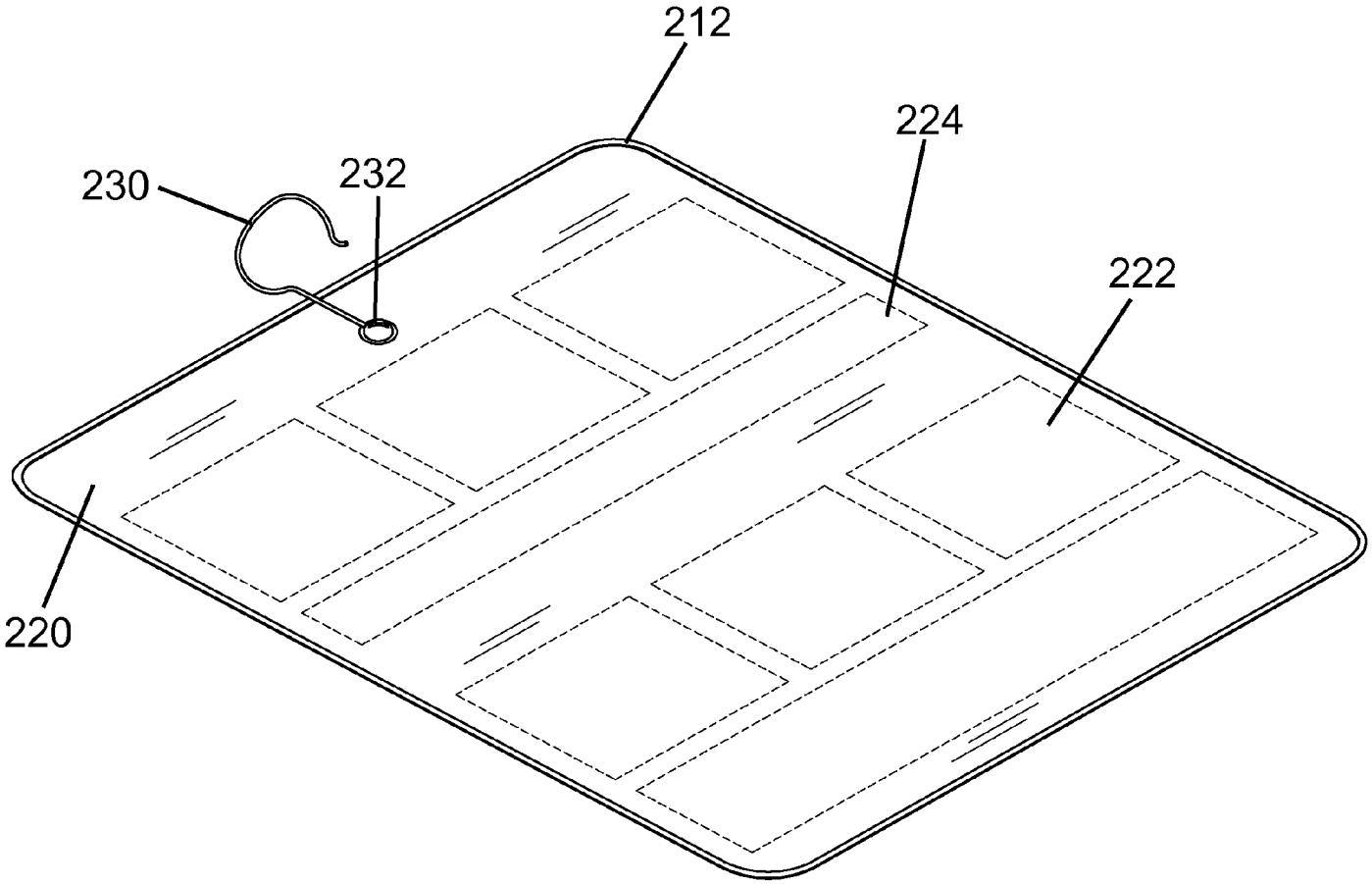
FIG. 4 shows a bottom perspective view of an upper portion of an embodiment of the disclosed technology.

FIG. 4 shows a bottom perspective view of an upper portion of an embodiment of the disclosed technology. The inner surface 220 of the upper portion 200 has multiple compartments or pockets 222, 224 (herein "pockets") for storing accessories, toiletries, and/or the like. The pockets 222, 224 may vary in size and/or configuration. In the embodiment shown, a longitudinal pocket 224 is provided for storing elongated items. A rectangular pocket 222 is provided for storing smaller items. The pockets 222, 224 may further employ zippers or some other fastening mechanism for enclosing contents therein.

The hook 230 extends from a point 232 on the inner surface 220. The point 232 may be a nut & bolt arrangement, configured such that the hook 230 may be freely rotated and/or completely removed from the upper portion 200. The hook 230 is adapted to be hung or suspended from any fixed location. Such a hook 230 is convenient when the bag 100 is used for travel purposes because the upper portion 200 may be easily detached and suspended for immediate access upon reaching a destination.

Figure 5:
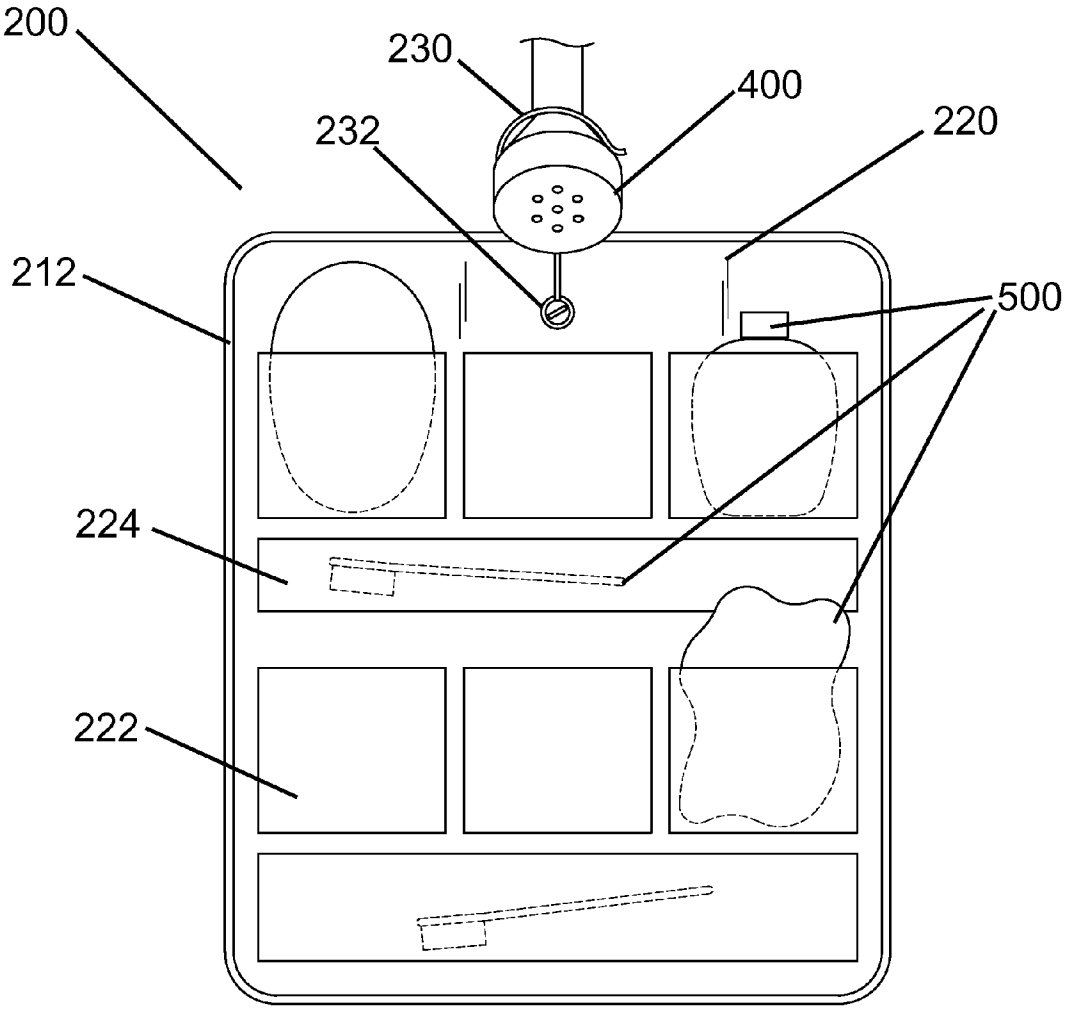
FIG. 5 shows an elevation view of a hanging upper portion with accessories of an embodiment of the disclosed technology.

FIG. 5 shows an elevation view of a hanging upper portion with accessories of an embodiment of the disclosed technology. In the example shown, the upper portion 200 is suspended from a shower head 400. Thus, the upper portion 200 is being used as a shower caddy of sorts. The inner surface 220 is facing outwards, thus granting convenient access to the pockets 222, 224. Numerous items 500 are stored in the various pockets 222, 224 of the upper portion 200. The longitudinal pockets may store elongated items, such as, for example, a toothbrush 500 as shown in FIG. 5. The rectangular pockets 222 may store, for example, small containers or soap bars. The shower head 400 is one example of a fixed member from which the upper portion 200 may be suspended. The upper portion 200 is versatile in that it may be mounted on any location and used for any application.

Figure 6:
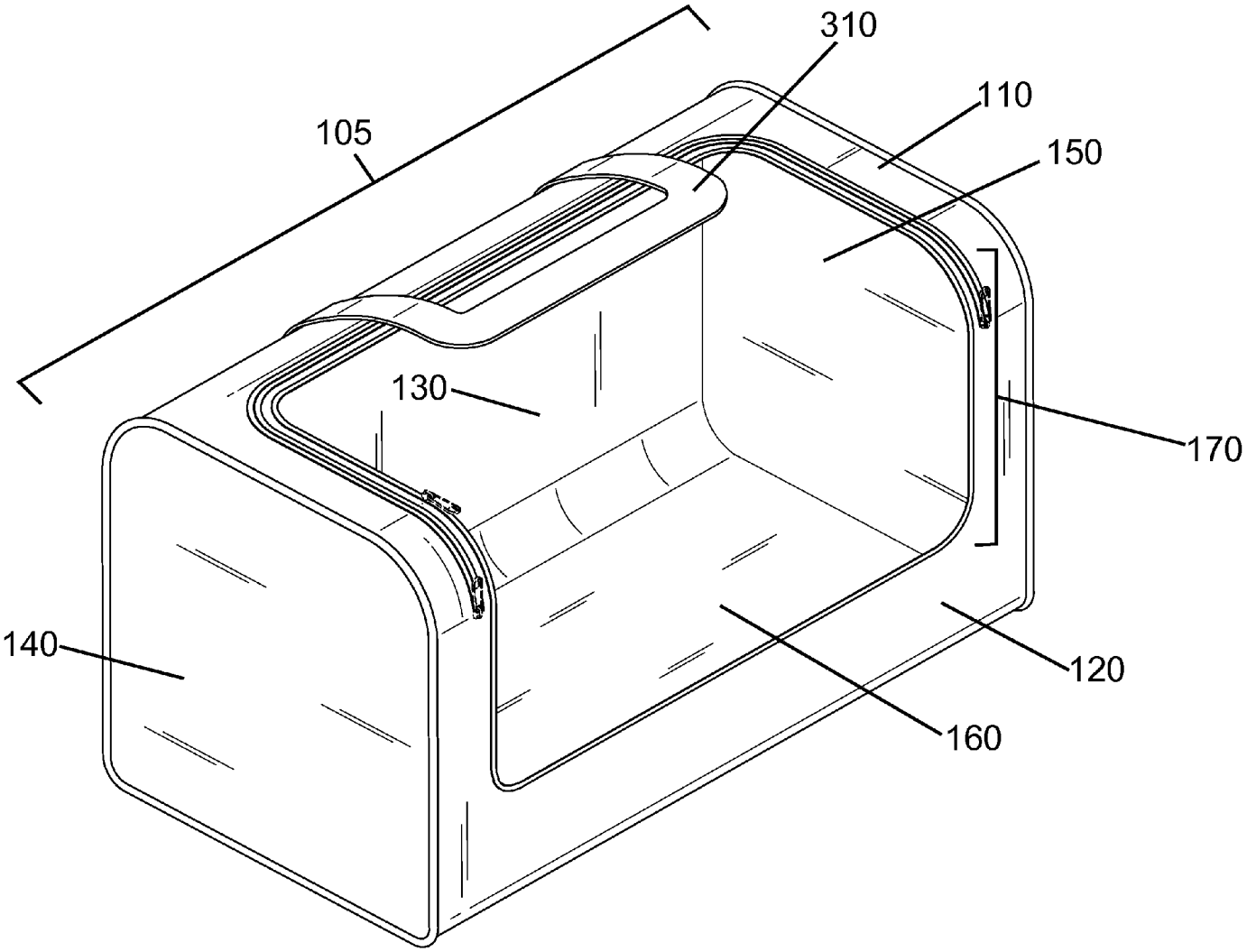
FIG. 6 shows a perspective view of the lower portion of the bag of FIGS. 1, 2 and 3, with the upper portion detached.

FIG. 6 shows a perspective view of the lower portion of the bag of FIGS. 1, 2 and 3, with the upper portion detached. With the upper portion 200 removed, the lower portion 105 may still retain its structural integrity, such that it stands upright and is capable of storing contents therein. The lower portion 105 may also be held upright by the contents occupying the interior 170. When used for travel, the lower portion 105 without the upper portion 200 provides easy access to the contents of the bag 100, such that no flap or lid obstructs direct access to the interior 170. The lower portion 105 may thus be used as a shelf or the like for storing the contents of the bag 100. As described, the bag 100 has a top side 110, bottom side 160, front side 120, back side 130, left side 140, and right side 150. In the embodiment shown, portions of the top side 110 and front side 120 are formed by the lower portion 105 of the bag 100, and thus remain after the upper portion 200 has been detached. The first strap 310 is affixed to the lower portion 105, and also remains after the upper portion 200 is removed.

Figure 7:
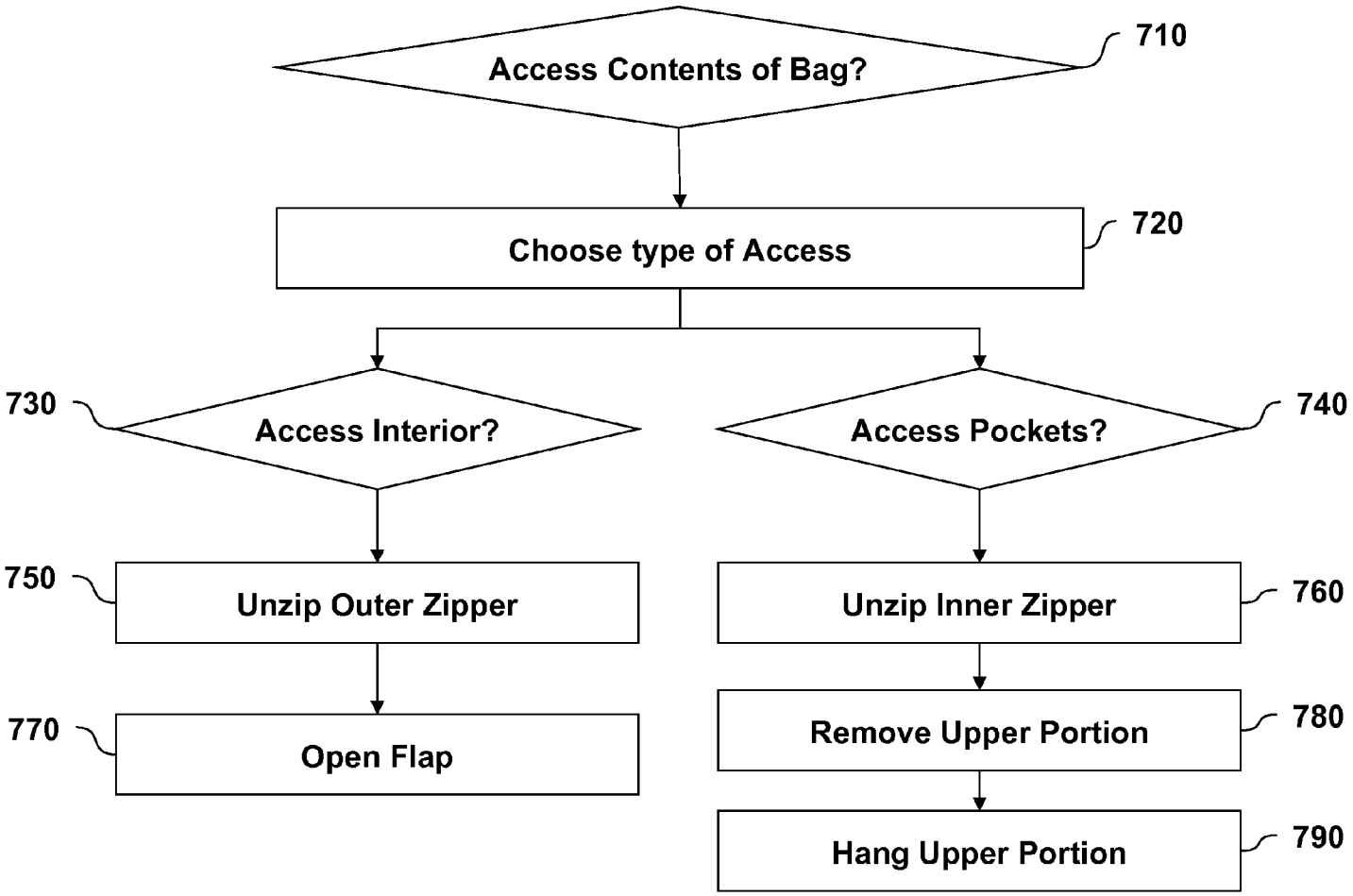
FIG. 7 shows a flow chart outlining steps of a method of using a bag of an embodiment of the disclosed technology.

FIG. 7 shows a flow chart outlining steps of a method of using a bag of an embodiment of the disclosed technology. The method begins with step 710 whereby a user desires to access the contents of the bag. In step 720, the user decides how he or she desires to access the contents of the bag. If the user merely desires to access the interior portion of the bag, as in step 730, then the user proceeds to unzip the outer zipper (step 750). Alternatively, if the user desires to access items stored in the pockets of the upper portion as in step 740, the user will unzip the inner zipper (step 760). After fully unzipping the inner zipper, in step 780, the user then removes the upper portion from the bag. Then, in step 790, the upper portion may be tethered or suspended from a stationary object, such as a shower head or towel rack.

It should be noted that while step 740 is entitled "Access pockets", in step 730 entitled "access interior" one may also access the pockets. That is, in unzipping or unfastening to access the interior of the bag, the pockets are also accessible in the interior of the bag. The pockets on the removable upper portion of the bag are thus accessible while the upper portion is zipped or otherwise fastened into the bag, as well as when the removable upper portion is removed.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

I claim:

1. A bag with a unitary bottom, left, right, front and back sides, and a top, said bag comprising:

a lower portion fully forming said bottom, said left, said right, and said back sides and at least a portion of said front and top sides of said bag;

a fully detachable upper portion comprising a removably attached part of said front and said top side, forming at least a portion of said front and top sides of said bag, and having a perimeter extending around an entirety of said detachable upper portion and at least one pocket enclosed and secured to said detachable upper portion on three sides;

an inner fastener removably attaching said upper portion to said lower portion, said inner fastener extending around an entirety of said perimeter of said detachable upper portion thereof such that said inner fastener extends across a majority of a length and width of said top side and said front side such that when said inner fastener is detached, at least a portion of all sides of said bag remain and when said upper portion is completely disconnected from said bag, said top, left, right, back, and front sides of said bag retain their shape;

an outer fastener running along and adjacent to portions of at least three of four sides of said inner fastener and parallel to all four sides of said inner fastener, said outer fastener extending around an exterior of said first inner fastener, and closably fastening an opening into said bag such that said detachable upper portion doubles as a three or more sided exterior flap for accessing an interior of said bag, wherein said outer fastener is distinct from said inner fastener, such that said inner fastener is situated on an interior of said outer fastener;

wherein when said inner fastener and said outer fastener are fastened, said upper portion and said lower portion are attached and form a contiguous unitary length of fabric along either side of said inner fastener along a length of said inner fastener; and wherein said at least one pocket of said detachable upper portion remains coupled to said interior when said inner fastener is completely unfastened and said detachable upper portion is completely detached, and such that said pocket remains accessible when either said inner fastener or said outer fastener is completely unfastened.

2. The bag of claim 1, wherein said outer fastener follows a path of said three or more sided flap formed by at least a portion of said detachable upper portion on said exterior of said inner fastener.

3. The bag of claim 2, wherein said upper portion bends around a curve when attached to said lower portion on all sides and flat when detached from said lower portion and hung from a first end.

4. The bag of claim 1, wherein said removably attached flexible top and front side comprises a rotatably affixed hanging device.

5. The bag of claim 4, wherein said hanging device is a hook.

6. The bag of claim 5, wherein said perimeter extending around the entirety of said removably attached top and front side is bent when attached to said bag and in a flat two-dimensional plane when said removably attached flexible top and front side is hanging from said hanging device.

7. The bag of claim 1, wherein said removably attached flexible top and front side further forms at least a portion of said back side.

8. The bag of claim 1, wherein said unitary bottom, left, right, and back side also forms at least a portion of said top side.

9. The bag of claim 1, wherein said unitary bottom, left, right, and back side also forms at least a portion of said front side.

10. The bag of claim 1, said inner fastener further comprising a resealable opening which simultaneously opens said bag and detaches said detachable upper portion.

11. The bag of claim 10, wherein at least a length of said resealable opening runs parallel said perimeter of detachable upper portion.

* * * * *